US006009960A

United States Patent [19]

Leitko, Jr. et al.

[11] Patent Number: 6,009,960

[45] Date of Patent: Jan. 4, 2000

[54] CORING TOOL

[75] Inventors: Curtis E. Leitko, Jr., Houston; Clarence D. Edmonson, Corpus Christi; Gary W. Clemens, Humble; Terry P. Clifton, Houston, all of Tex.

[73] Assignee: Diamond Products International, Inc., Houston, Tex.

[21] Appl. No.: 09/014,116

[22] Filed: Jan. 27, 1998

[51] Int. Cl.[7] ..... E21B 25/14

[52] U.S. Cl. ..... 175/250; 175/254

[58] Field of Search ..... 175/244, 246, 175/247, 249, 250, 252, 253, 254, 242; 166/319, 332.1, 332.3

[56] References Cited

U.S. PATENT DOCUMENTS

| | | | |
|---|---|---|---|
| 2,445,494 | 7/1948 | Redmond | 436/27 |
| 3,146,837 | 9/1964 | Bridwell | 175/59 |
| 3,938,589 | 2/1976 | Mott | 166/325 |
| 4,230,192 | 10/1980 | Pfannkuche | 175/59 |
| 4,256,192 | 3/1981 | Aumann | 175/233 |
| 4,317,490 | 3/1982 | Milberger et al. | 175/20 |
| 4,371,045 | 2/1983 | McGuire et al. | 175/17 |
| 4,406,328 | 9/1983 | Brooks | 166/332.3 |
| 4,552,229 | 11/1985 | Radford et al. | 175/240 |
| 4,553,613 | 11/1985 | Radford | 175/250 |
| 4,576,234 | 3/1986 | Upchurch | 166/319 |
| 4,603,749 | 8/1986 | Davis et al. | 427/393.4 |
| 4,605,075 | 8/1986 | Radford et al. | 175/58 |
| 4,606,416 | 8/1986 | Knighton et al. | 175/58 |
| 4,607,710 | 8/1986 | Radford | 175/249 |
| 4,638,872 | 1/1987 | Park et al. | 175/46 |
| 4,651,828 | 3/1987 | Doremus | 166/319 |
| 4,651,835 | 3/1987 | Davis | 175/58 |
| 4,664,205 | 5/1987 | Knighton et al. | 175/58 |
| 4,735,269 | 4/1988 | Park et al. | 175/46 |
| 4,887,676 | 12/1989 | Hallez | 175/250 |
| 4,930,587 | 6/1990 | Young et al. | 175/251 |
| 4,950,844 | 8/1990 | Hallmark et al. | 175/59 |
| 5,010,765 | 4/1991 | Duckworth et al. | 73/152.11 |
| 5,253,720 | 10/1993 | Radford et al. | 175/58 |

FOREIGN PATENT DOCUMENTS

| | | |
|---|---|---|
| P 4377 | of 0000 | Norway . |
| P 4378 | of 0000 | Norway . |
| 1506069 | 7/1989 | U.S.S.R. . |
| 1 400 096 | 7/1975 | United Kingdom . |
| WO 94/28281 | 5/1994 | WIPO . |

OTHER PUBLICATIONS

"Posiclose" Brochure, Security DBS No Date.

*Primary Examiner*—David Bagnell
*Assistant Examiner*—John Kreck
*Attorney, Agent, or Firm*—Sankey & Luck, L.L.P.

[57] ABSTRACT

A coring assembly comprising a body securable at its upper end to a mandrel add at its lower end to a core catcher housing, a ball sleeve slidably disposed about said mandrel and moveable between a first and a second position, a ball closure valve disposed in said body and moveable with said mandrel between the first and second position, the combination operable to remotely cut and collect a loosely consolidated core sample.

27 Claims, 9 Drawing Sheets

FIG. 1
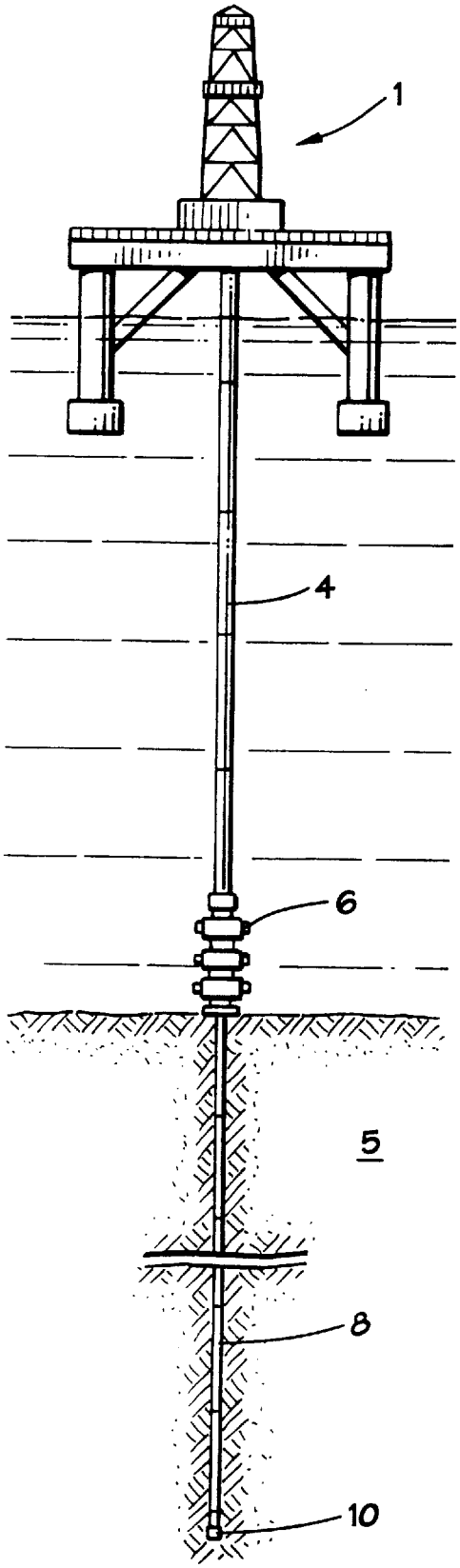
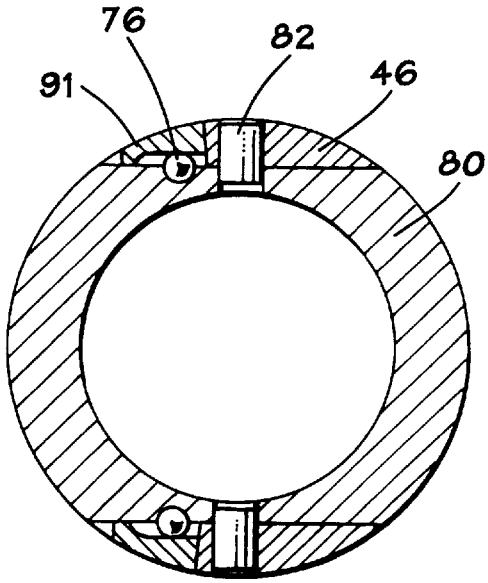
FIG. 3C

FIG. 5
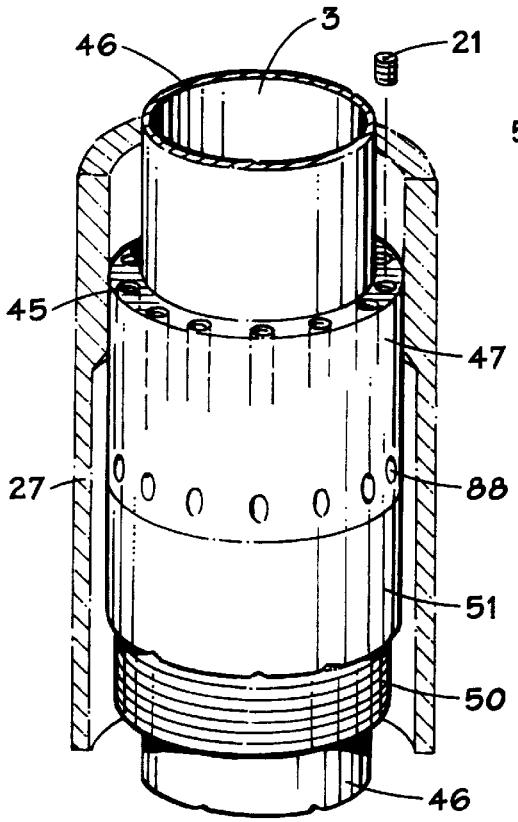
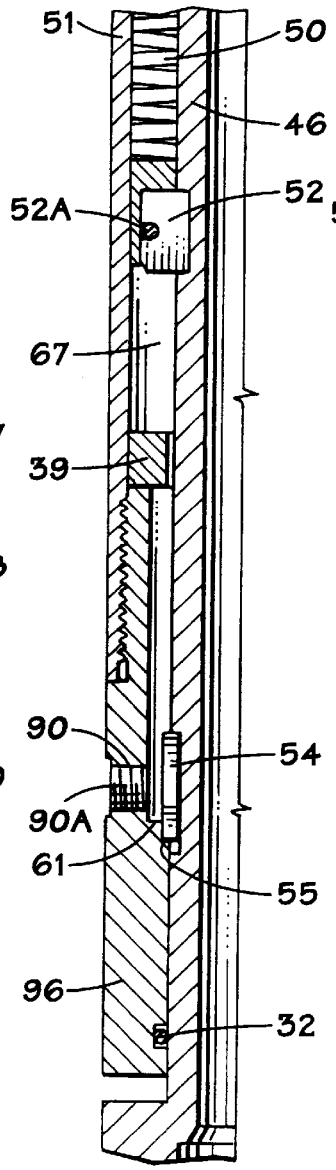
FIG. 6A
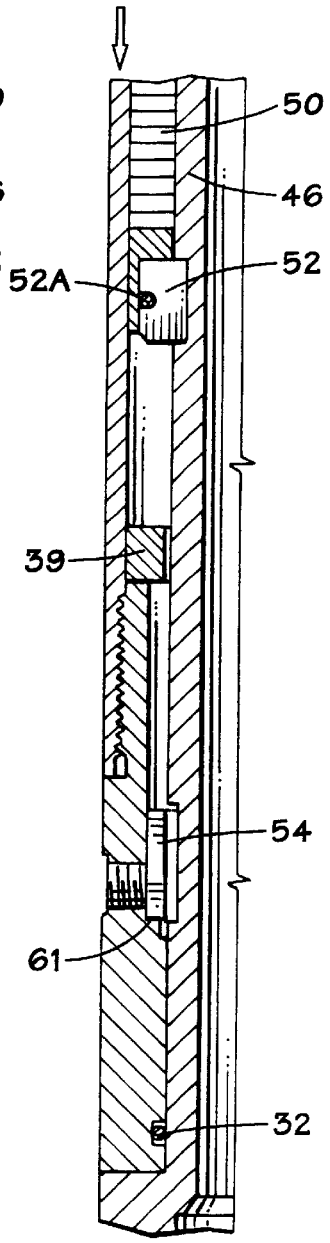
FIG. 6B

FIG. 10
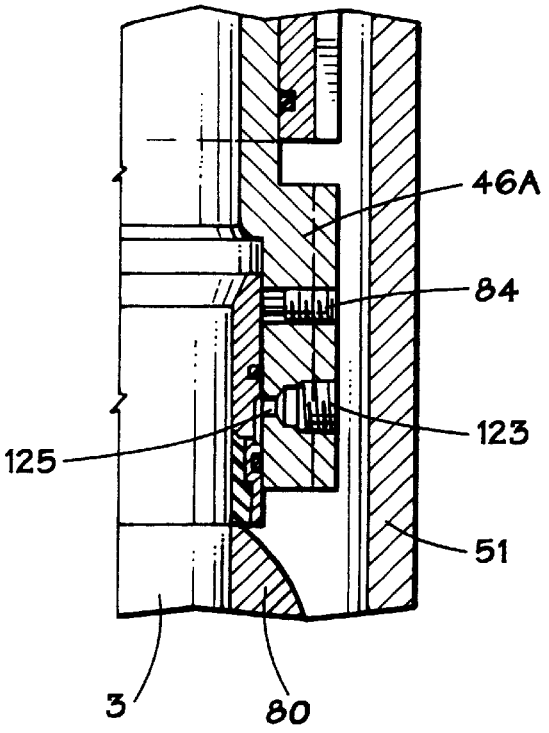
FIG. 11
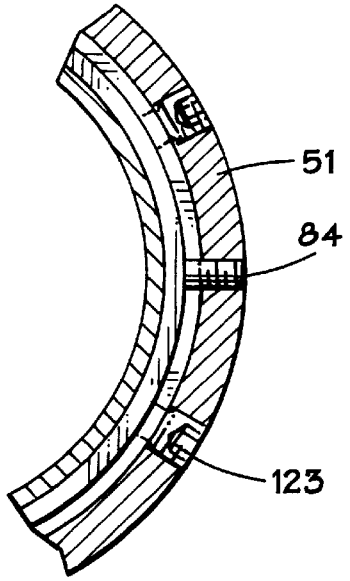
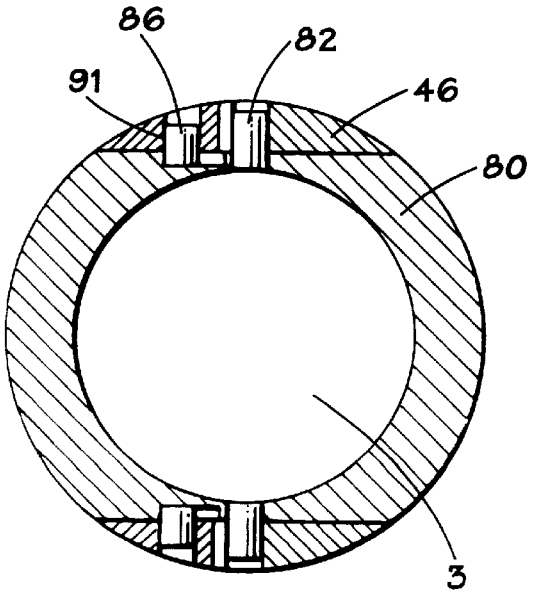
FIG. 12
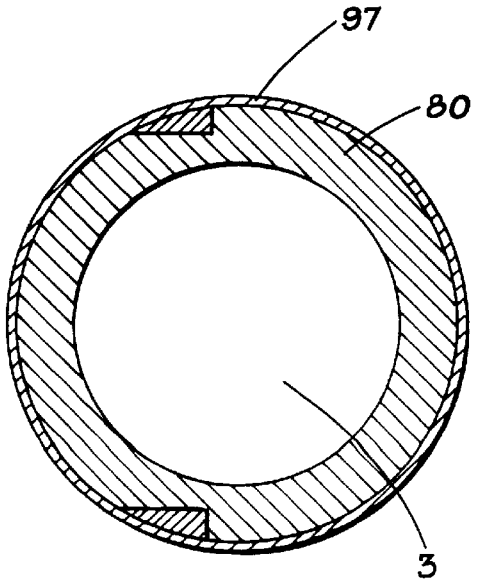
FIG. 13

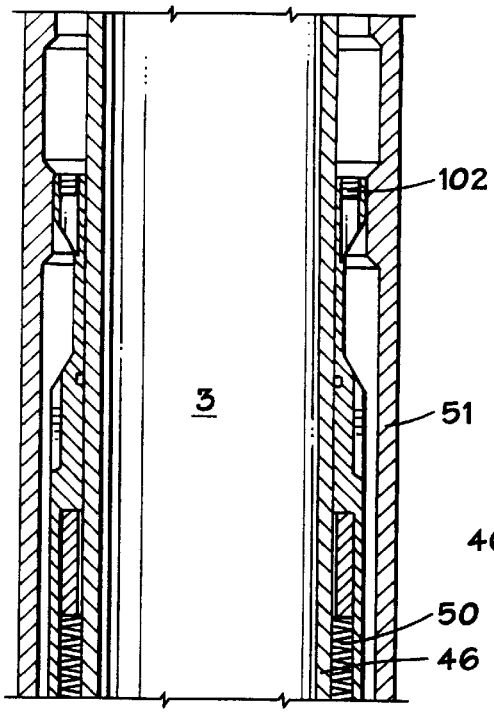
FIG. 15
FIG. 16
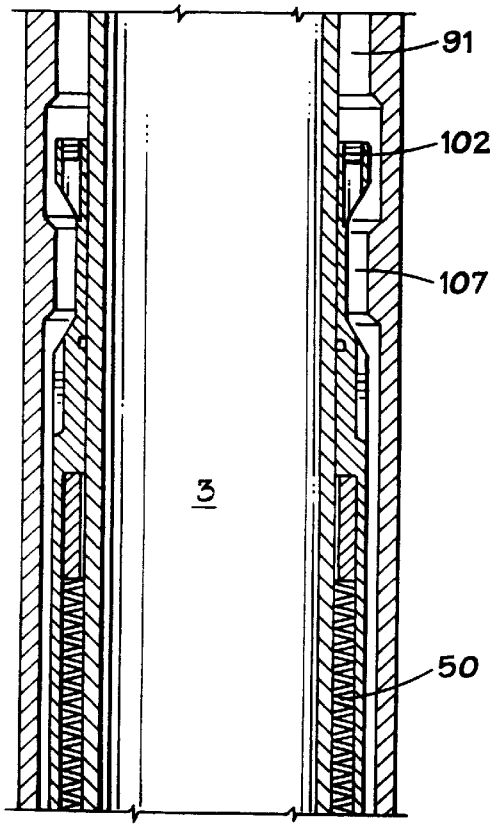
FIG. 14
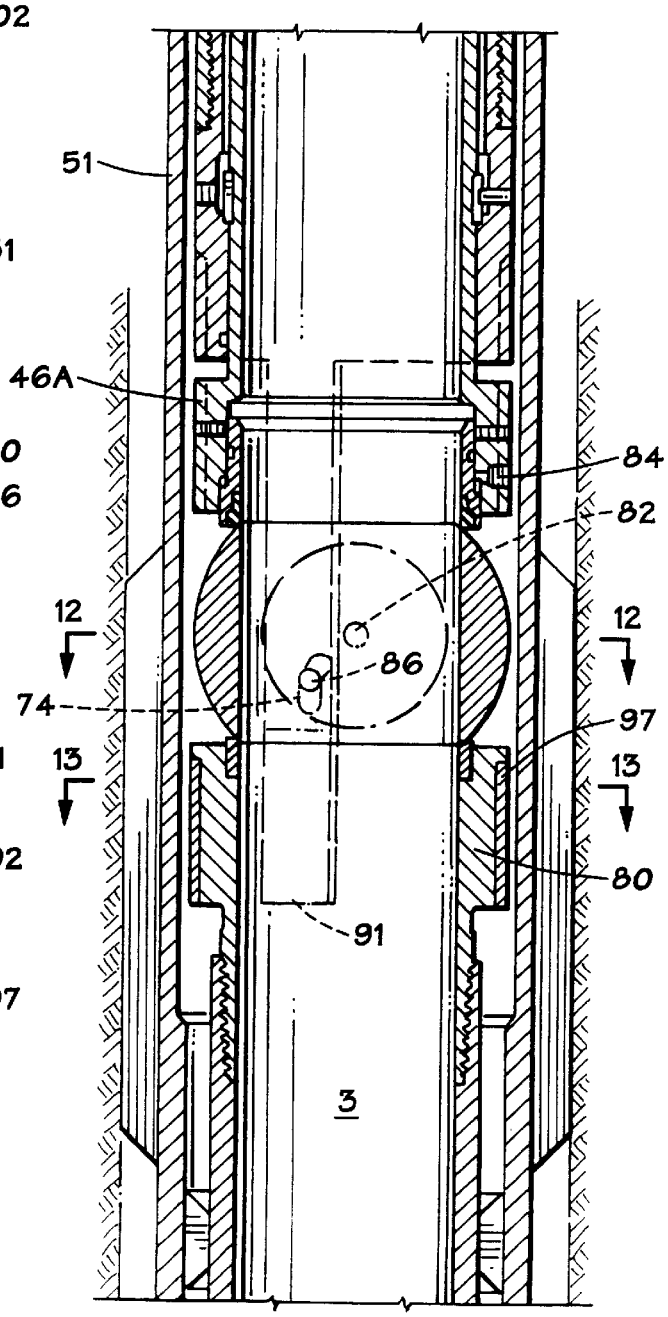

CORING TOOL

BACKGROUND OF THE INVENTION

1. Field of the Invention

The present invention is directed to an apparatus for forming and retaining a core sample within a downhole tool where said apparatus is adapted to be coupled to a conventional coring assembly. More specifically, the present invention is directed to a full closure valve and core retention assembly for use in forming and collecting unconsolidated or loosely consolidated core samples where said valve is externally actuated by surface pump pressure.

2. Background

To analyze the amount of hydrocarbons which are contained in a soil at a particular depth in the proximity of a subterranean well generally requires the extraction of a sample of well material. An analysis of this material yields the percent of fluid and/or gas contained in the sample, which information may then be utilized to determine the type of fluid contained therein. A core analysis is also valuable from the standpoint of the stratigraphic analysis of the core itself. In view of the cost of extracting the core, which may be considerable in the case of a deep well, it is generally important to extract the largest core sample possible. It is also important to retrieve the sample without substantial stratigraphic disturbance.

Coring is a common practice in the field of petroleum exploration. However, it is not uncommon to encounter formations which are considered impossible to core because of their unconsolidated nature. For example, oil-sand, water-sand, or loose debris constitute types of unconsolidated formations which are commonly found in the field and which are extremely difficult to core. Even if the loose, unconsolidated material can be successfully cored or cut, the problem still remains as to how to remove such material from the bore hole in a manner such that its original stratigraphic orientation is undisturbed. Typically in prior art core catcher assemblies, unconsolidated material is prone to drop out of the core barrel when the core barrel is lifted to the surface of the well.

A number of core catchers have been designed which utilize a collection of arcuate wedge shaped segments in a "clam shell" or "flapper valve" type of arrangement. In such designs, the valve segments are designed to move apart so as to allow the upward movement of the core within the core barrel. When the core undergoes downward movement, however, the valve segments engage the core and rotate to a shut or fully closed position. This downward movement of the valve segments is typically gravitationally induced.

Disadvantages of such clam shell or flapper valve designs involve their propensity to create an obstruction upon which the core may jam as it is being cut. Obstruction or disturbance of the core is further increased by the use of spring biased flapper valves which are sometimes used to increase the reliability of the system. Alternatively, valve segments of such designs are often prone to disturb the original stratification of the core sample.

Further disadvantages of prior art closure valves involved their manner of actuation. Prior art closure valves typically involve a closure mechanism which is gravitationally induced, as above described, or which is actuated by variations in fluid flow to the tool. An example of a fluid actuated closure valve is seen in U.S. Pat. No. 4,522,229. Fluid actuated closure valves such as those disclosed in the '229 patent are generally biased in an open position by fluid flow through the bore of the tool. When a core sample has been taken, the valve is closed by channeling or rerouting fluid flow so as to induce valve closure. This is typically accomplished by using a drop ball sub at the surface and physically dropping a check ball through the bore defined in the workstring. This ball descends through the well fluid in the bore of the tool and ultimately comes to rest in the main fluid portal so as to restrict fluid flow therethrough. This channeling of fluid flow results in the closure of the valve.

Disadvantages with this type of system include the inconvenience and time associated with breaking the workstring at the surface. Due to reliance on gravity, this type of technique, as well as flapper or clam shell designs, are also largely ineffectual in horizontal wells.

SUMMARY OF THE INVENTION

The present invention addresses the above described and other disadvantages of prior art closure valves and associated retention mechanisms for use in retaining loosely consolidated or unconsolidated cores.

The present invention is directed to a full closure valve and retention apparatus which is designed to be connected to an inner tube of a drill string and is adapted for use in combination with a conventional coring bit. The combination valve and retention means is used for the formation and retention of a core which is cut by the coring bit and which is collected and stored within the inner tube of the apparatus.

The present invention generally comprises a tubular body or barrel which is attachable at its upper end to a conventional coring barrel and which is provided at its lower end with a closure mechanism or valve adapted to cut and retain the soil core within the body. To aid in retrieval of the core sample, a conventional core catcher housing may be disposed below the closure valve. The valve itself comprises a ball shaped element through which is disposed a bore of adequate size to allow the through passage of the core sample. This ball is pivotally secured in the body such that, upon rotation, the bore through the ball is moved to a position normal to the axis of the tool and the drill string. In such a fashion, the core is both severed and retained in the core barrel by the rotation of the ball.

Actuation of the valve closure mechanism or the invention is accomplished by varying fluid pressure to the tool. In operation, the ball closure mechanism is spring biased in a "closed" position, but is held in an "open" position by a locking mechanism when it is run in the hole. When a core of adequate size is gathered in the core barrel, fluid pressure is increased so as to trip the ball closure mechanism to a "closed" position. The closure mechanism of the invention does not require the integrity of the drilling string to be breached in order to effect actuation.

The present invention has a number of advantages over prior art closure valves and core retention assemblies. One such advantage is the ability of the present device to collect and retain loosely consolidated or unconsolidated core samples in substantially their original stratigraphic orientation. A second advantage is the ability of the invention to operate in both vertical and horizontal wells.

Yet another advantage is the overall savings observed in terms of both time and convenience. This savings is made possible by way of the actuation means of the valve.

BRIEF DESCRIPTION OF THE DRAWINGS

FIG. 1 is a side view of a typical semi-submersible drilling platform in relation to a drill string.

FIG. 3C is a cross sectional view cut through lines 3—3 in FIG. 3B.

FIG. 5 is a partial cut away, perspective view of the actuator subassembly illustrating the pressure drop valve.

FIGS. 6A and 6B are partial, sectional views of the actuation mechanism of one embodiment of the invention

FIG. 10 is a detail, cross sectional view of the valve release mechanism of the embodiment illustrated in FIG. 9.

FIG. 11 is a top, cross sectional view of the locking mechanism of the embodiment illustrated in FIG. 9.

FIG. 12 is a top, cross sectional view of the pivot means of the embodiment illustrated in FIG. 9 as drawn through plane 12—12.

FIG. 13 is a top, cross sectional view of the valve seat of an alternate embodiment of the invention as drawn through plane 13—13.

FIG. 14 is a side cross sectional view of an alternate embodiment of the invention, illustrating the ball valve assembly.

FIG. 15 is a detail, cross sectional view of an alternate embodiment of the invention illustrating the flow restriction means when the ball valve is situated in a "open" position.

FIG. 16 is a detail, cross sectional view of an alternate embodiment of the invention illustrating the flow restriction means is situated in a "closed" position.

DESCRIPTION OF THE PREFERRED EMBODIMENTS

Figure 2A:
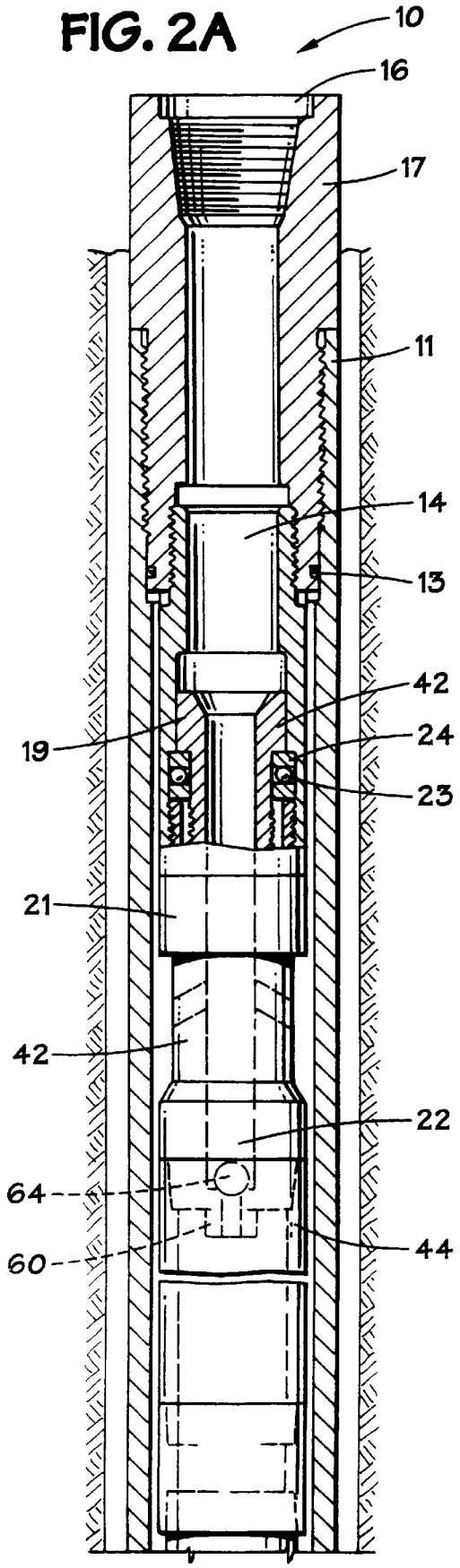
FIGS. 2A and 2B are cross sections of a core catcher assembly including the full closure valve and retention means of the present invention.

The present invention is directed to an externally powered core catcher and valve mechanism adapted to cut cores in unconsolidated and loose formations in a manner such that the core, when cut, is stratigraphically undisturbed. The externally powered core catcher and valve assembly is designed to be utilized in conjunction with a conventional core barrel in a fashion described in greater detail below. The valve assembly of the invention is externally actuated and is thus not dependent on any type of co-action with the core.

Unconsolidated formations of the type targeted by the present invention are usually encountered in marine drilling operations. FIG. 1 illustrates a typical semi-submersible drilling platform 1 from which distends a casing string 4 to a conventional blow-out preventer 6. In FIG. 1, drill string 8 continues below the blow-out preventer 6 through the seabed 5 to the formation of interest, with the coring apparatus referenced at 10.

Figure 2B:
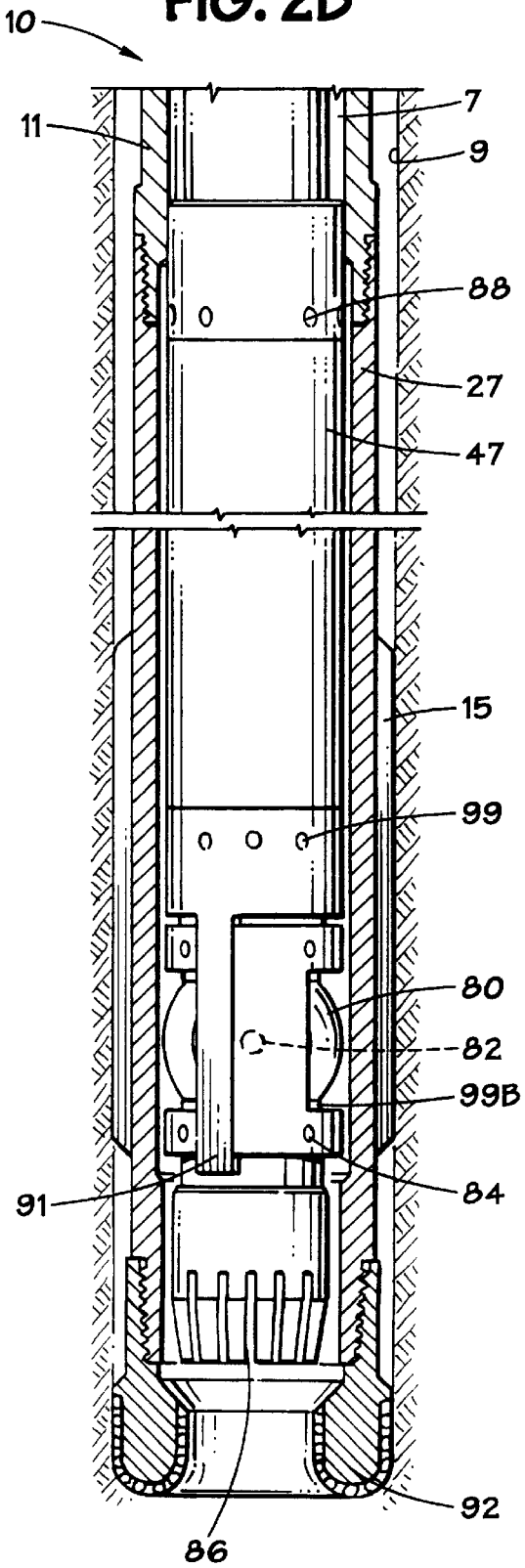

FIGS. 2A–2B illustrate a cross-section of one embodiment of the core catcher and valve assembly 10 of the present invention as it may be connected to the inner barrel of a conventional coring tool (not shown). The inner barrel and bearing assembly illustrated in FIG. 2 includes a safety joint pin 17 through which is disposed a bore 16 to allow for fluid flow in a generally conventional fashion. At its lower end, safety joint 17 is threadedly coupled in co-rotatable relation to safety joint box 11 which in turn is threadedly coupled at its lower end to a bit sub 27. The integrity of the seal between joint 17 and safety joint box 11 is preserved by an O-ring 13. Bit sub 27 is coupled to a conventional coring bit 92. To maintain a relatively stationary orientation in the wellbore 9, bit sub 27 may be provided with stabilizers 15 as illustrated in FIG. 2B. A core catcher is shown at 86 in FIG. 2B.

In the embodiment illustrated in FIGS. 2A–2B, a bearing assembly 14 is concentrically disposed within and rotationally and longitudinally fixed to box 11. Assembly 14 includes a bearing retainer 21 which is rotatably journalled to bearing assembly 14 by means of conventional ball bearings 23. Ball bearings 23 are disposed within a bearing race 24 defined in corresponding adjacent portions of retainer 21. Thus, bearing retainer 21 is longitudinally fixed with respect to box 11 while being rotatably secured thereto. In actual drilling operations, box 11 and joint pin 17 are actuated by tension applied to the kelly (not shown) at the drilling plalform 1. During such operations, bearing retainer 21 remains stationary, thereby allowing other elements depending therefrom to also remain rotationally stationary with respect to safety joint box 11.

At its lower end, bearing retainer 21 is coupled to a bearing shaft 42 which is situated rotationally independent of safety joint box 11. At its lower portion, shaft 42 is threadedly coupled to an inner barrel 44 which in turn is threadedly connected to an inner barrel sub 43. (See FIGS. 2–3) Inner barrel sub 43 is threadedly connected to a mandrel 46. The relative positions of the shaft 42, inner barrel 44, inner barrel sub 43, and mandrel 46 are illustrated at FIGS. 3A–4A. Shaft 42 is provided with an inner bore 22 which at its lowermost portion threadedly receives a retainer 60. Retainer 60 defines a restricted diameter bore 57 and a valve seat 43 to accommodate a pressure relief valve ball 84.

Figure 3A:
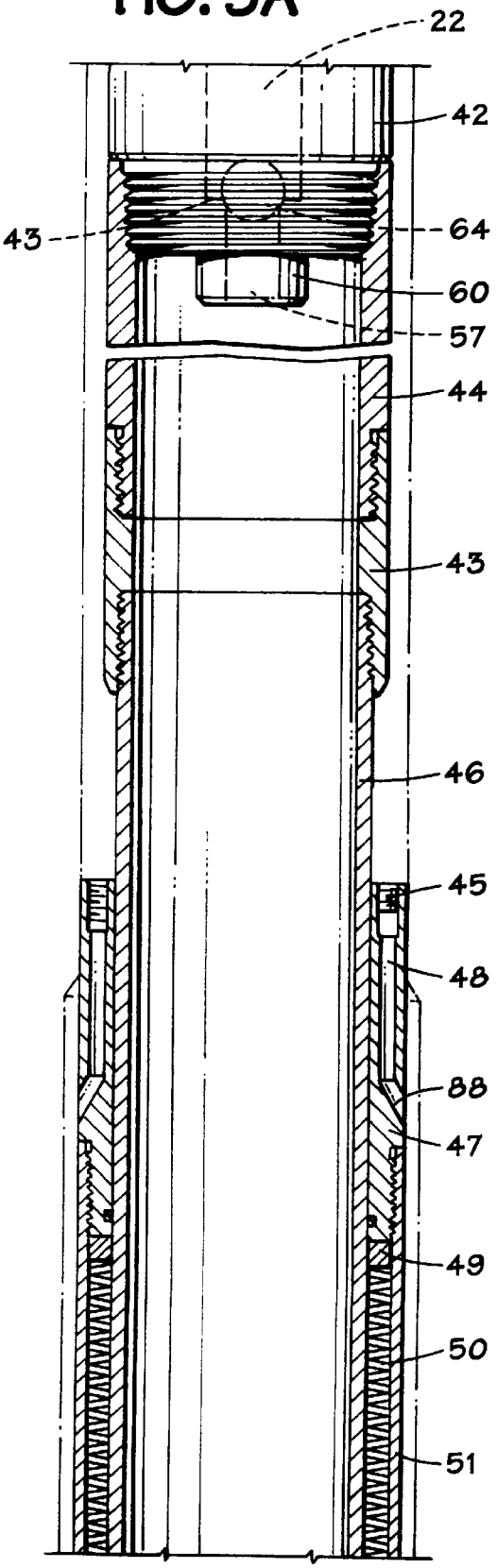
FIGS. 3A and 3B are detail cross sections of one embodiment of the full closure valve and retention means of the invention illustrating the valve in an "open" orientation.
Figure 3B:
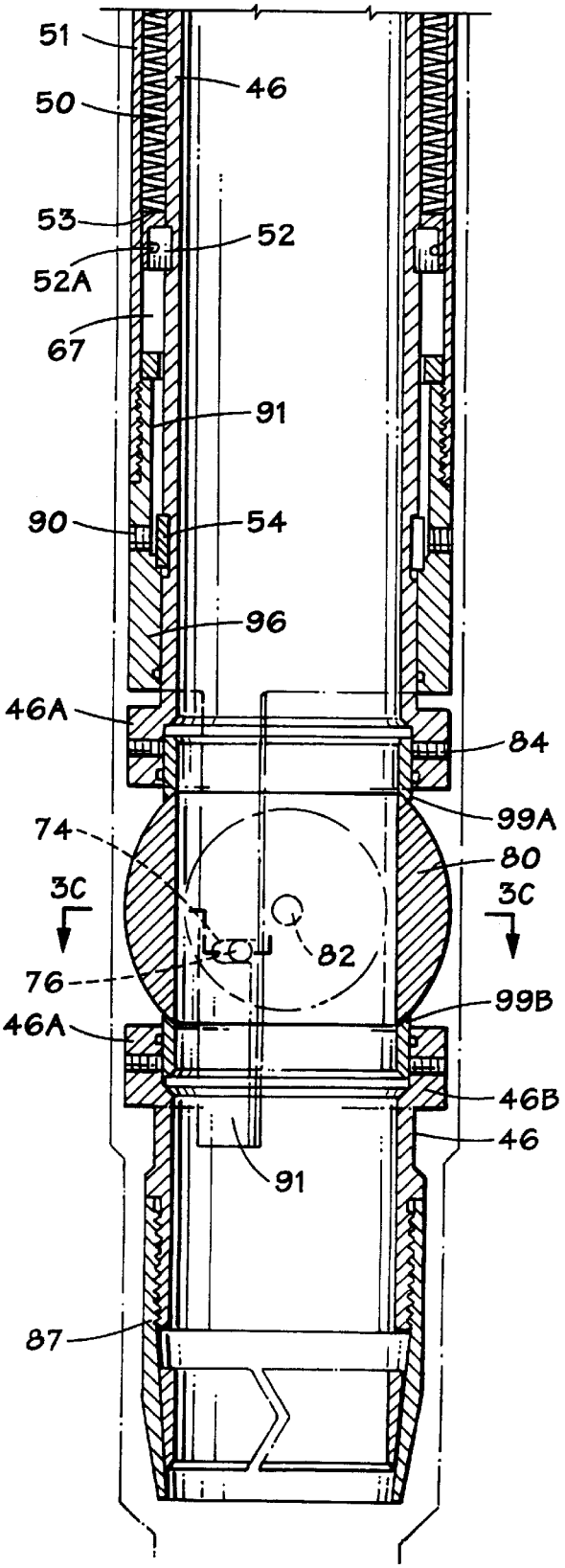

Referring to FIGS. 3A–3B, an annular piston 47 is slidably disposed about mandrel 46 above a set of disc springs 50. Piston 47 is threadedly coupled to a spring housing tube 51 and the combination is axially moveable between an upper and a lower orientation along mandrel 46. Annular piston 47 is preferably separated from disc springs 50 by a spacer 49 which is used to "tune"the exact and desired preload of disc springs 50 as will be further described herein. Disc springs 50 are supported at their lower extent by a split ring 52 and split ring retainer 53 as illustrated. Split ring 52 has an outside diameter slightly smaller than the inside diameter of spring housing 51 so as to provide for slidable cooperation there between Referring to FIGS. 3–5, annular piston 47 is provided with a series of fluid portals 48 which define a series of fluid inlets 45 and a series of fluid outlets 88. Fluid inlets 45 are adapted to receive well fluid discharged around mandrel 46 in the annulus 7 defined between mandrel 46 and bit sub 11. Well fluid flowing through this annulus 7 must now through there inlets 45 since mandrel 46 defines a close tolerance fit within the interior of said bit sub 11 as illustrated in FIG. 28.

Annular piston 47 is moveable between an upper and a lower position as influenced by the upward bias of springs 50 and the influence of well fluid pressure which exerts a downward pressure thereon. Annular piston 47 is normally biased in an upper or "closed" position as illustrated in FIG. 4, but may be locked in a lower second or "open" position as illustrated in FIG. 3. Springs 50 are circumferentially disposed about mandrel 46 in a stacked array as illustrated. In a preferred embodiment, dire springs area type manufactured by Key Bellvilles under the tradename "Bellville Springs". Due to the relatively narrow cross section of springs 50, the flat load and the setting load of springs 50 will ordinarily differ. In a preferred embodiment, springs 50 create a flat load of 8,000 lbs. and a setting load of 7,500 lbs. These loads may be slightly varied or "tuned" by the varying longitudinal length of spacer 49.

It is possible to accurately evaluate the setting and release pressure of springs 50 from manufacturing specifications and tolerances. With exception to modification available through spacer 49, it is economically desirable that each valve assembly be substantially identical in construction. Not all well sites, however, are provided with similar well fluid pumping capacities. It may therefore be desirable to include means to vary or modify the amount of pump pressure necessary to overcome the upward bias of springs 50 in order to move piston 47 downwardly to a "release" position as further discussed herein.

In a preferred embodiment, inlets 45 are designed to accommodate such flexibility. Inlets 45 are preferably provided with a threaded opening 45A as illustrated in 3A and 4A. Openings 45A are receivable to one or more threaded plugs 21 as illustrated in FIG. 5. The insertion of plugs 21 enables the downward movement of piston 47 with a decreased amount of fluid flow than would be the case absent the insertion of such plugs. Depending on the pump facilities available at a given well site, it may be desirable to use one or a number of such plugs 21 in order to achieve an optimum release pressure.

An actuator sub 96 is circumferentially disposed about mandrel 46 in spaced relation below split ring 52 and is threadedly connected to housing 51. In such a fashion, actuator sub 96 is similarly movable between an upper and a lower position as will be further described. At its upper extent, actuator sub 98 describes an inner diameter significantly larger than the outer diameter of mandrel 46. The difference in the diameter of actuator sub 96 and mandrel 46 defines an annulus 93 which accommodates the movement of a lock ring 54 as will be further described below. A series of setting portals 90 are formed at the lowermost portion of annulus 91 in order to allow external access to lock ring 54. In a preferred embodiment, it has been found desirable to include a minimum of five to six setting portals 90 equally spaced about the circumference of actuator sub 96. To enable ready access to lock ring 54, portals 90 are preferably one quarter of an inch or greater in diameter, though this size is dependent on the given application. Portals are preferably threaded and receive standard alien screws 90A as illustrated in FIG. 6A.

Lock ring 54 is circumferentially disposed about mandrel 46 and is accommodated in a groove or channel designated 34. The depth of channel 34 is preferably no more than one-half the thickness of lock ring 54. In such a fashion lock ring 54 when situated in said channel 34 defines a shoulder 55 as illustrated in FIGS. 6A–6B. Shoulder 55 fits into a corresponding groove 61 formed in the interior of actuator sub 96 as illustrated, and when thus fitted serves to prevent the upward movement of actuator sub 96. In such fashion, lock ring 54 serves to hold or lock actuator sub 96 in a lower or cocked position. Lock ring 54 preferably comprises a conventional C-ring formed of a highly resilient steel alloy. Lock ring 54 is normally outwardly biased about mandrel 46 as illustrated in FIG. 6B. In this orientation, shoulder 55 is not held within groove 61 on actuator sub 96. This orientation will be referred to herein as the "unlocked" position and is shown in FIG. 4. In this position, actuator sub 96 is situated in an "upper" position. Conversely, the "locked" position occurs when lock ring 54 is held in lock channel 34 by the cooperation of shoulder 55 and groove 61 as previously described. The "locked" position is illustrated in FIG. 3. In the "locked" position, actuator sub 96 is situated in a lower or "open" position.

Figure 7:
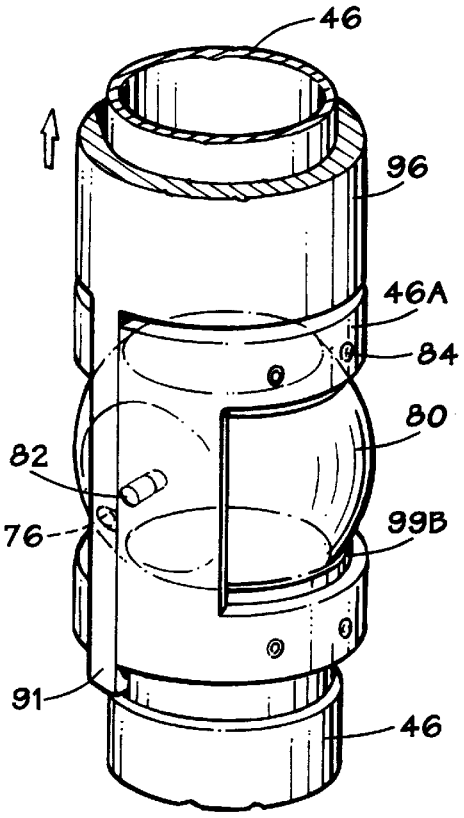
FIG. 7 is a detail view of the full closure valve assembly.
Figure 8:
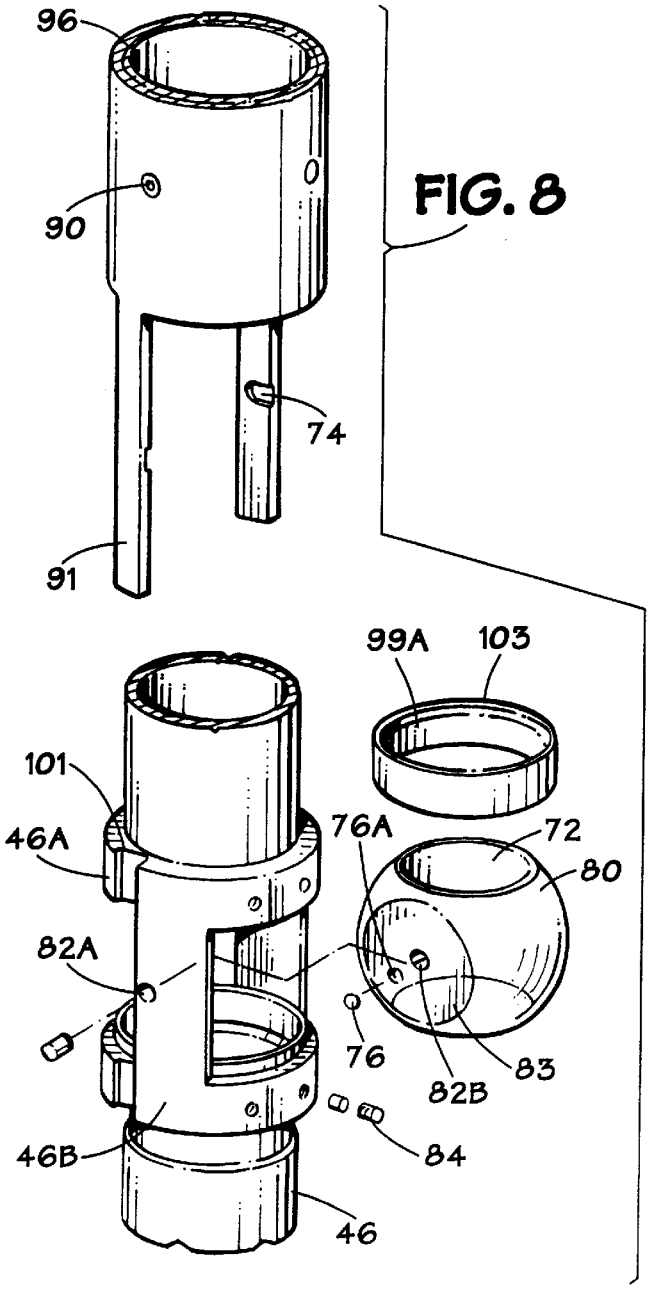
FIG. 8 is an exploded view of the valve assembly of FIG. 7

At its lower end, actuator sub 96 defines an inside diameter closely matched to the outside diameter of mandrel 46. This close tolerance fit serves to effect a metal-to-metal seal between the two members, which seal is enhanced by a conventional O-ring 32. At its lowermost extent, actuator sub 96 defines a pair of actuator arms 91 which, in a preferred embodiment, are diametrically opposed as illustrated in FIG. 8. Actuator arms 91 are slidably disposed in specially configured slots 88, formed in mandrel 46. (See FIG. 8.) Arms 91 are also provided with a pair of keyways 74 disposed in an orientation generally normal to the axis of the workstring 8. Keyways 74 accommodate two ball keys 76 in a manner which will be described in greater detail below. As illustrated in FIGS. 7 and 8, actuator arms 91 are preferably L-shaped at their lowermost extremity At is lower end, mandrel 46 defines two "windows" which are formed by machining two parallel cuts in mandrel 46 through to bore 3. The resulting configuration may alternatively be described as a "web" structure or housing. This web structure or housing accommodates a ball closure valve as will be further described below. Immediately above and below the web structure, mandrel 48 describes corresponding connection rings 46A and 46B for use in securing upper and lower valve seats, 99A and 99B, respectively. In a preferred embodiment, connection rings define a larger outside diameter than the mandrel body 46. Lower ring 46B also serves as a stop to upward movement by actuator sub 96. This stop is created by the physical interaction between the L-shaped bottom portion of actuator arm 91 and the larger diameter of lower ring 46B as illustrated in FIG. 7.

With specific reference to FIGS. 3C and 7–8, the ball close valve assembly comprises a modified spheroid or ball 80 having an outside diameter slightly smaller than the outside diameter of rings 46A and 46B, yet larger than seats 99A and 99B. In a preferred embodiment, ball 80 includes a bore 72 disposed therethrough of a diameter the same or substantially the same diameter as the bore 3 formed through mandrel 46. Ball 80 also includes two flattened portions or pivot planes 83 which are formed coplanar to each other and are disposed parallel to the major axis defined through bore 72. Pivot planes 83 are provided with two diametrically opposed pivot sockets 82B as illustrated. In a preferred embodiment, pivot sockets 82B are both centered with respect to pivot planes 83. Pivot sockets 82B define a pivot axis normal to the axis formed through bore 72 and accommodate pivot pins 82 which are disposed through apertures 8A formed in mandrel 46. Ball 80 is thus able to pivot about pivot sockets 82B between an "open" orientation, in which case ball bore 72 aligns with the axis of the workstring 8, and a "closed" position in which case the axis of bore 72 is rotated to a position normal to the axis of the workstring 8. The relative position of ball 80 in an "open" and "closed" position may be seen by comparing FIGS. 3B and 4B.

Figure 4A:
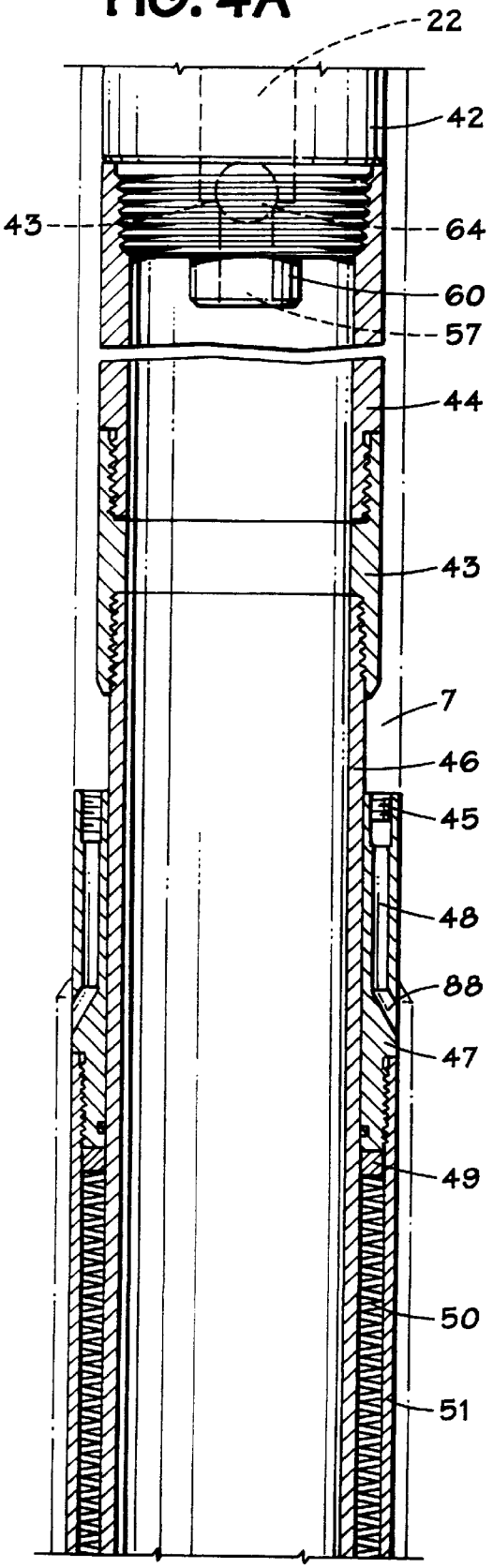
FIGS. 4A and 4B are detail cross sections of the full closure valve and retention means of the invention illustrating the valve in a "closed" orientation.
Figure 4B:
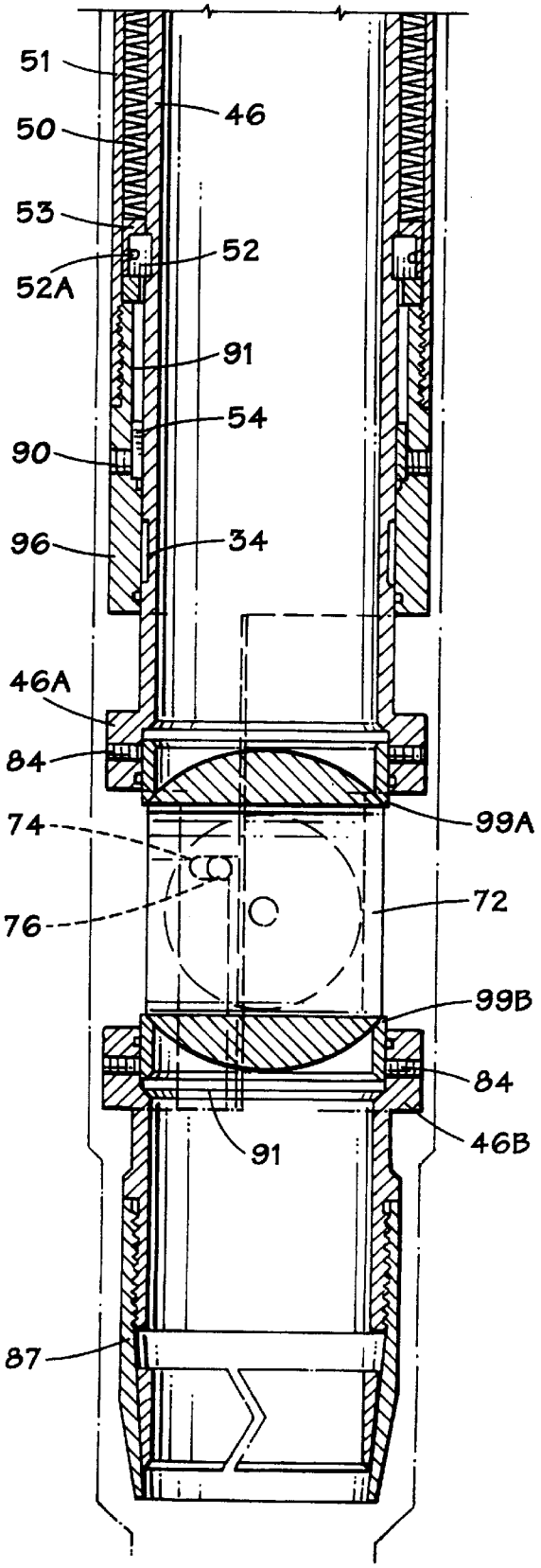

Pivot planes 83 are provided with retention sockets 76A sufficient to retain ball keys 76. It is envisioned that keys 76 comprise conventional ball bearings of a size complementary to keyways 74. Keys 76 may be seemed in retention sockets 76A by a suitable fixative, e.g., epoxy. Alternatively, keys 76 may be welded in place. In a preferred embodiment, sockets 76A are of a depth sufficient to allow the protrusion of approximately one-half of each ball key 76 so as to provide for a slidable, contacting interaction between key 76 and keyways 74. Referring to FIGS. 3B and 4B, keys 76 are eccentrically situated on pivot planes 83 such that they are held within keyways 74 when the actuator sub 96 moves between a "locked" and an "unlocked" position.

Ball 80 is seated with respect to mandrel 46 and actuator sub 96 via an upper and a lower bearing seat, 99A and 99B, respectively. Seats 99A and 99B are ring-shaped in configuration and preferably include beveled contract areas 103 so as to accommodate the curvature of ball 80. Seats 99A and 99B are fixed within mandrel 46 via set screws 84 which are threadedly disposed through rings 46A and 46B and are received in corresponding apertures formed in seats 99A and 99B as illustrated in FIG. 8. In order to reduce frictional wear on ball 80, seats 99A and 99B are preferably formed of a softer material, e.g., a brass or bronze alloy.

Figure 9:
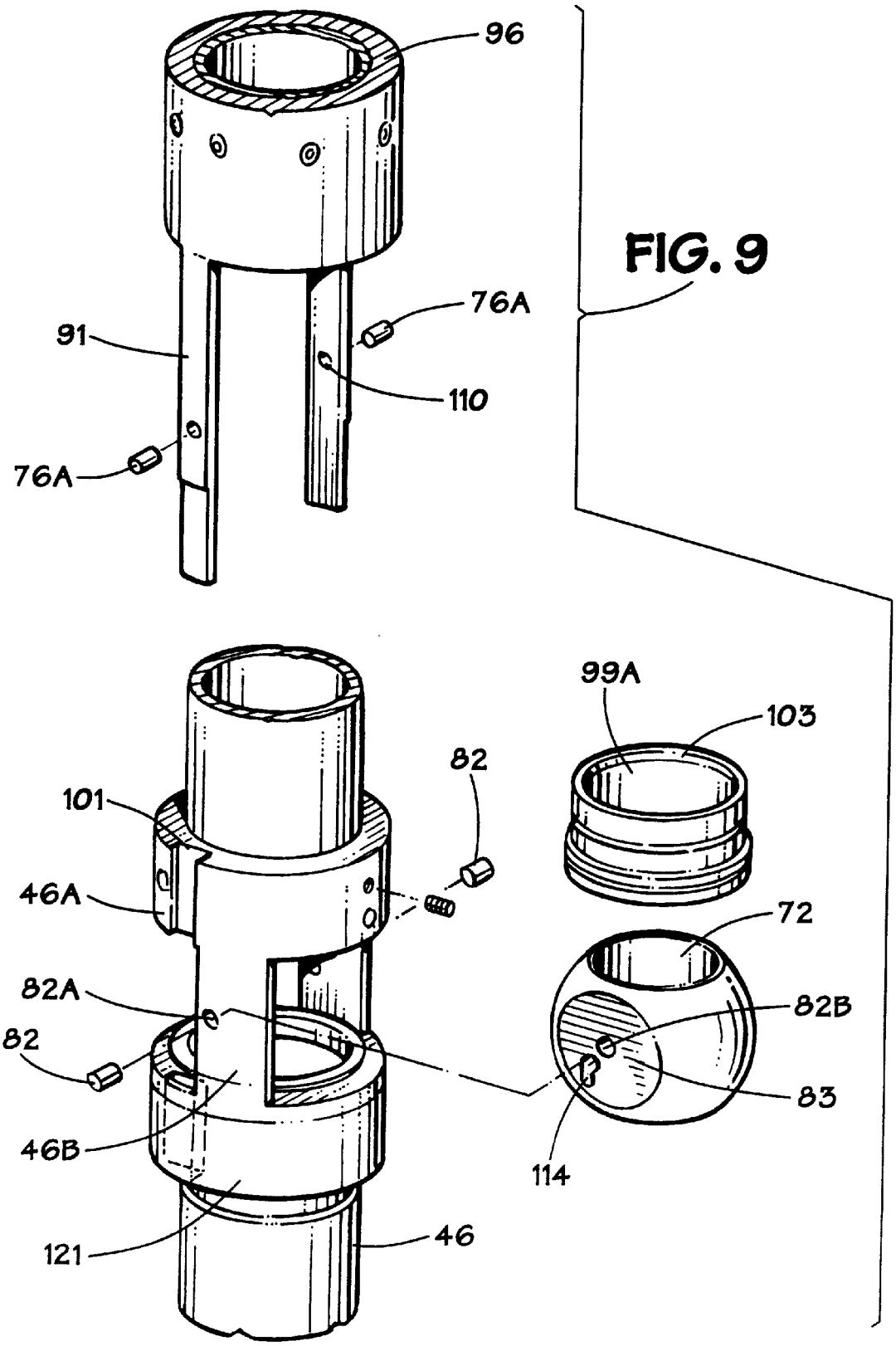
FIG. 9 is an exploded view of an alternate embodiment of the invention.

An alternate embodiment of the ball closure mechanism of the present invention may be seen by reference to FIGS. 9–16. Referring specifically to FIGS. 9–10, dowels or pins 76A may be substituted for bore keys 76 to create a more robust pivot mechanism, where one end of pins 76A are receivable in apertures 110 formed in arms 91. In this embodiment the travel formerly provided by the eccentric shape of keyway 74 is now provided by a crescent shaped track 114 formed on the pivot plane 83 of ball 80, which track 114 accommodates the free end of pin 76A. Also in this embodiment, the outward distortion of arms 91 is further prevented by replacing slots 88 with an aperture 121 formed in mandrel 46 as illustrated. To further prevent distortion and/or radial spreading of arms 91, a reinforcing ring 97 may affixed about actuation sub 96. (See. FIG. 13). As in prior embodiments, upper seat 99B is secured with screws 84 as illustrated in FIGS. 10–11.

The operation of the apparatus of the present invention may be described as follows by reference to the drawings and especially FIGS. 3 and 4. Preliminary to running the tool downhole, ball 80 must be moved and locked in an "open" position as previously described. In the "open" orientation, the axis of bore 72 is aligned with the axis of bore 3 so as to allow the upward progression of a core within the tool. In this position, springs 50 are compressed and actuator sub 96 is moved to a lower or cocked position with respect to mandrel 46. Actuator sub 96 is initially moved downwardly with respect to mandrel 46 by use of a hydraulic press (not shown) which in one form consists of a cylindrical tube sized to accommodate the tool and apply a sufficient axial force to compress springs 50.

When disc springs 50 have been compressed to a position where the groove 61 of actuator sub 96 is situated below locking ring 54, ring 54 is deformed into groove 34 by threading allen screws 90A into portals 90. The threading of screws 90A in this fashion serves to physically compress ring 54. When ring 54 has been compressed in this manner, actuator sub 96 is allowed to slide upwardly along mandrel 46 until shoulder 55 locks into groove 61. In such a fashion, ring 54 is maintained in a compressed position and actuator sub 96 is locked in a lower position. When the valve assembly has been "locked", ball 80 is positioned in an "open" orientation as illustrated in FIG. 3A and 3B. The relative movement of ball 80 with respect to sub 96 is accomplished by the travel of keys 76 in keyways 74 so as to urge harmonious interaction therebetween.

When the tool has been thusly prepared, it is then secured to a conventional coring assembly by threading the mandrel 46 onto the inner barrel 44 via inner barrel sub 43. The entire assembly is then lowered into the wellbore until contact is made with the bottom of the hole. Once contact is made, drilling fluid is pumped through the drill string 8 between the inner barrel and the outer barrel core assembly past the inside diameter of the core bit 92. The drilling assembly is then rotated and weight is placed on the drill string 8 to penetrate the formation. The rotation of drill bit 92 results in the formation of core sample which feeds up into the inner barrel of the coring assembly.

It is possible at the surface to determine when the core barrel is filled by noting the marked decrease in drilling penetration which occurs at this time. When the inner barrel has thus been filled, fluid pressure is increased on the coring assembly. This pressure increase is detectable on the rig floor and is thus available as an indicator, sometimes referred to as a "tattletale," that the ball has closed. The amount of this fluid pressure increase is determined by the load created by springs 50 and the use of plugs 21 or the like as previously described. This increase in pressure creates a downward force against annular piston 47 through fluid portals 48. Once a sufficient downward force is established on annular piston 47, piston 47 is moved downwardly, thus allowing the expansion of lock ring 54 which no longer retained by the superimposition of actuator 96 moves out of channel 34. When ring 54 has thus expanded to a non-compressed position, fluid flow through portals 48 is decreased or stopped, thus allowing the rapid, upward movement of actuator sub 96 as induced by disc springs 50. This upward movement quickly pivots ball 80 approximately 90 degrees, thus severing the core and sealing the core inside the bore tube. The tool and core can then be retrieved to the surface.

An alternate embodiment of the "tattletale" feature of the invention is illustrated in FIGS. 10 and 14–16. This embodiment mat be desirable is some instances where modern gauge packages do not adequately enable an accurate means to detect the actuation of ball valve 80 by a slight pressure increase induced by the closure of ball 80 in the prior embodiment. In this alternate embodiment, when ball 80 is situated in an "open" or cocked position, fluid is compelled to pass through one or more flow restrictions 102. Restrictions 102 form a close tolerance, metal to metal seal with the inner portion of the outer barrel core assembly. The combination serves to significantly narrow the passageway for well fluid pumped downwardly into annulus 107, and results in a high pressure reading on the rig floor. By reference to FIGS. 10–11, this embodiment provides a pressure plug 123 to prevent a pressure lack between annular 107 and bore 3, which plug 123 defining a small bore 125 to allow for fluid communication therebetween. When, however, piston 47 is moved downwardly as a result of the movement of ball to a "closed" position, as discussed above, restrictions 102 are moved out of contacting relation with the inner portion of bit sub 27, thereby opening annular fluid passageway 107. Fluid pressure detectable on the rig floor now drops to close to zero, and is therefore more easily detectable by even improperly calibrated equipment.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

We claim:

1. A full closure valve and core retention assembly for connection with a coring tool having an inner barrel, comprising:

a mandrel connectable to the inner barrel of the coring tool at its upper end and connectable at its lower end to a core catcher housing, said mandrel defining a body about its intermediate portion for housing a ball closure valve, said mandrel being provided with a longitudinal bore disposed therethrough;

said ball closure valve comprising a substantially spherical ball through which is disposed a bore, said ball defining opposed flattened portions which include pivot means about which said ball pivots in said housing between an open and a closed position, said open position aligning the bore through said ball with the bore of said mandrel, said closed position moving said bore to a position normal to the axis defined by the mandrel bore;

a sleeve slidably secured on said mandrel and moveable between a first and a second position, said sleeve being operably coupled to said ball such that said sleeve and ball are cooperatively moveable between said open and closed positions, said sleeve being normally biased in said closed position;

means for locking said sleeve and said ball in said open position;

piston means responsive to fluid pressure to unlock said sleeve from said open position so as to enable said ball to move to said closed position thereby severing the core and closing said inner barrel.

2. The full closure valve of claim 1 wherein said sleeve is biased in a closed position by a plurality of disc springs circumferentially disposed about and secured to said mandrel.

3. The full closure valve of claim 1 including means to move said ball closure valve to said closed position.

4. The full closure valve of claim 3 including means to vary the amount of force necessary to move said ball closure valve to said closed position.

5. The full closure valve of claim 1 including means to vary the amount of fluid pressure needed to unlock said ball closure valve from said open position.

6. The full closure valve of claim 1 wherein said ball closure valve includes an upper and lower ball seat receivable in said housing.

7. The full closure valve of claim 1 including indicator means for an operator at the surface to ascertain when the ball closure valve has moved to a closed position.

8. The full closure valve of claim 7 where said indicator means includes a fluid restriction means when said ball closure valve is in said open position, which restriction means is removed when said valve is moved to a closed position, thereby resulting in a pressure drop detectable by the operator.

9. A closure valve assembly for connection within a coring tool having an inner barrel, comprising:

a mandrel connectable to said inner barrel at its upper end and its lower end defining a housing for a ball closure valve, said mandrel also defining a fluid bore longitudinally disposed therethrough, said housing being defined by a second bore formed through said mandrel normal to the axis defined by said fluid bore, said housing being bounded by an upper and a lower support means;

an actuator sleeve circumferentially disposed on and in slidable relation to said mandrel, said sleeve moveable between a first and a normally biased second position, the lowermost portion of said actuator sleeve partially extending over said housing and being operably coupled to a closure valve;

a closure valve rotatably disposed about a pivot axis, said valve including a bore disposed therethrough where the plane described by the rotation of the axis of said valve is parallel to the axis of said fluid bore, said valve defining a generally spherical shape with two flattened portions oppositely disposed about said pivot axis, said flattened portions also accommodating a key cooperative with a keyway formed in said actuator sleeve, said key being eccentrically disposed with respect to said pivot axis;

said closure valve moveable between a first and a second position coincident with the first and second position of said actuator sleeve such that the bore of said valve when in a first position is substantially coaxial with the axis of said fluid bore, the axis of the bore of said valve when in a second position being situated substantially normal to the axis of said fluid bore; and means for locking said actuator sleeve in a first position.

10. The closure valve assembly of claim 9 further including a core catcher housing secured below the housing formed in said mandrel.

11. The closure valve assembly of claim 9 wherein the actuation sleeve is biased in a second position by a plurality of disc springs circumferentially disposed about said mandrel in a stacked arrangement.

12. The closure valve assembly of claim 11 further including means to modify the amount of force required to compress said springs to a locked position.

13. The closure valve assembly of claim 9 further including means to unlock said actuator sleeve from said first position such that said sleeve and said valve may move to said second position.

14. The closure valve assembly of claim 13 where said unlocking means includes fluid pumped against a restriction on said actuator sleeve.

15. The closure valve assembly of claim 13 including a fluid actuated piston means to trip said actuator sleeve from a locked first position to a normally biased second position.

16. The closure valve assembly of claim 15 including means to modify the amount of fluid flow necessary to trip said actuator sleeve from a locked first position to a normally biased second position.

17. The closure valve assembly of claim 9 where said locking means includes a resilient ring slidably disposed between said actuator sleeve and said mandrel.

18. The full closure valve of claim 9 including indicator means for an operator at the surface to ascertain when the closure valve has moved from said first to said second position.

19. The full close valve of claim 18 where said indicator means includes a flow restriction when said valve is in said first position, which restriction is removed when said valve is moved to said second position, thereby resulting in a pressure drop detectable by the operator.

20. A full closure core catcher for use within a coring tool having an inner tube and a longitudinal axis, comprising:

a tubular body securable to said inner tube at its upper end and having an inner bore disposed therethrough, said body defining a housing about its intermediate portion receivable to a ball closure value;

an actuator sleeve slidably disposed on said body between an upper and a lower position, said sleeve operably engaged to said ball closure valve and being normally biased in said upper position;

a ball valve rotatably disposed in said housing between an open and a closed position, said ball having a bore disposed therethrough where the open position of said ball corresponds to said lower position of said sleeve;

means for locking said actuator sleeve in said lower position;

fluid actuated means to release said lock means so as to enable said actuator sleeve to move to said upper position, thereby moving said ball valve to a closed position.

21. The full closure core catcher of claim 20 wherein said biasing means includes a plurality of disc springs longitudinally disposed about said tubular body and operably disposed with said actuator sleeve.

22. The full closure core catcher of claim 20 including fluid actuated means to release the locking means so as to enable said actuator sleeve to return to an upper position.

23. The full closure core catcher of claim 22 including means to vary the force necessary to unlock said actuation sleeve.

24. The full closure core catcher to claim 20 wherein said ball valve is provide with oppositely disposed flattened portions defining a centered rotational axis therethrough where said rotational axis is formed normal to the axis defined through the bore of said ball.

25. The full closure core catcher of claim 24 wherein a key is eccentrically secured on each flattened portion with respect to said rotational axis, said key operably receivable in a keyway formed in said actuator sleeve.

26. The full closure core catcher of claim 20 further including means detectable by the operator for determining when the ball valve is in a closed position.

27. The full closure core catcher of claim 26 where said detector means including a flow restrictor created through said catcher when said actuator sleeve is disposed in an upper position where fluid flow through said flow restriction is substantially increased when said sleeve is moved to said lower position.

* * * * *

UNITED STATES PATENT AND TRADEMARK OFFICE

CERTIFICATE OF CORRECTION

PATENT NO. :6,009,960

DATED :January 4, 2000

INVENTOR(S) :Leitko, et al.

It is certified that error appears in the above-identified patent and that said Letters Patent is hereby corrected as shown below:

In the Abstract:

At line 2, please replace "add" with - - and - -.

At column 2, line 43, please replace "or" with - - of - -.

At column 4, line 38, please replace "84" with - - 64 - -.

At column 4, line 51, please replace "there between" with - - therebetween - -.

At column 4, line 57, please replace "now" with - - flow - -.

At column 4, line 58, please replace "there" with - - these - -.

At column 4, line 59, please replace "28" with - - 2B - -.

At column 5, line 2, please replace "dire" with - - disc - -.

At column 5, line 2, please replace "area" with - - are a - -.

At column 5, line 37, please replace "98" with - - 96 - -.

At column 5, line 50, please replace "alien" with - - allen - -.

At column 6 line 29, please replace "48" with - - 46 - -.

At column 6, line 54, please replace "8A" with - - 82A - -.

At column 6, line 64, please replace "seemed" with - - secured - -.

At column 8, line 8, please add - - a - - before coring assembly, etc.

UNITED STATES PATENT AND TRADEMARK OFFICE

CERTIFICATE OF CORRECTION

PATENT NO. : 6,009,960

DATED : January 4, 2000

INVENTOR(S) : Leitko et al.

It is certified that error appears in the above-identified patent and that said Letters Patent is hereby corrected as shown below:

Claim 20, Column 10, Line 60. Please replace "value" with - - valve - -.

Claim 24, Column 11, Line 19. Please replace "to" with - -of - -.

Claim 24, Column 11, Line 20. Please replace "provide" with - - provided - -.

Signed and Sealed this

Twenty-first Day of November, 2000

*Attest:*

Q. TODD DICKINSON

*Attesting Officer*

*Director of Patents and Trademarks*